US007077787B1

(12) United States Patent
Wiesman

(10) Patent No.: US 7,077,787 B1
(45) Date of Patent: Jul. 18, 2006

(54) VARIABLE RESISTANCE HAND GRIP

(76) Inventor: Robert Wiesman, 58-21 79th Ave., Ridgewood, NY (US) 11385

( * ) Notice: Subject to any disclaimer, the term of this patent is extended or adjusted under 35 U.S.C. 154(b) by 0 days.

(21) Appl. No.: 11/056,668

(22) Filed: Feb. 12, 2005

Related U.S. Application Data

(60) Provisional application No. 60/544,507, filed on Feb. 12, 2004.

(51) Int. Cl.
*A63B 23/16* (2006.01)
*A63B 21/045* (2006.01)

(52) U.S. Cl. ..... 482/49; 482/127

(58) Field of Classification Search ..... 482/44–50, 482/126–128, 51–53; D21/648
See application file for complete search history.

(56) References Cited

U.S. PATENT DOCUMENTS 4,623,141 A * 11/1986 Salvino ..... 482/49
4,753,434 A * 6/1988 Salvino ..... 482/49
4,756,522 A * 7/1988 Sandoval ..... 482/126
5,060,934 A 10/1991 Winston
5,360,385 A 11/1994 Wang
5,507,712 A * 4/1996 Chang ..... 482/126
5,529,551 A 6/1996 Chin
6,881,177 B1 * 4/2005 An ..... 482/49

* cited by examiner

*Primary Examiner*—Gregory L. Huson
*Assistant Examiner*—Fenn C Mathew

(57) ABSTRACT

The present invention concerns that of a new and improved apparatus for exercising, conditioning, and strengthening various hand, wrist, and forearm muscles. The apparatus comprises a central coil that has two attached handles. By squeezing the handles, an individual can strengthen various hand, wrist, and forearm muscles. An adjustment mechanism is enclosed which will allow an individual to change the tensile strength within the central coil, requiring a greater amount of power to move the handles together the same distance, thereby enabling the apparatus to exercise the short-twitch muscles (strength muscles) rather than the long-twitch (endurance) muscles.

3 Claims, 2 Drawing Sheets

VARIABLE RESISTANCE HAND GRIP

CROSS-REFERENCE TO RELATED APPLICATIONS

This application claims the benefit of U.S. Provisional Application No. 60/544,507, filed Feb. 12, 2004.

BACKGROUND OF THE INVENTION

The present invention concerns that of a new and improved apparatus for exercising, conditioning, and strengthening various hand and wrist muscles.

DESCRIPTION OF THE PRIOR ART

U.S. Pat. No. 5,529,551, issued to Chin, discloses a hand grip exercise device and having a resistance member comprised of a cylinder assembly having adjustable levels requiring different amounts of force to close the gap.

U.S. Pat. No. 5,360,385, issued to Wang, discloses a hand exercise device comprised of two pivoting handles with an adjustable member for changing the damp magnitude of the device.

U.S. Pat. No. 5,060,934, issued to Winston, discloses a hand exercise device comprised of two grip handles and capable of allowing for the spring to be replaced to vary the resistance.

SUMMARY OF THE INVENTION

The present invention concerns that of a new and improved apparatus for exercising, conditioning, and strengthening various hand, wrist, and forearm muscles. The apparatus comprises a central coil that has two attached handles. By squeezing the handles, an individual can strengthen various hand, wrist, and forearm muscles. An adjustment mechanism is enclosed which will allow an individual to change the tensile strength within the central coil, requiring a greater amount of power to move the handles together the same distance, thereby enabling the apparatus to exercise the short-twitch muscles (strength muscles) rather than the long-twitch (endurance) muscles.

There has thus been outlined, rather broadly, the more important features of a hand-held exercise apparatus that the detailed description thereof that follows may be better understood and in order that the present contribution to the art may be better appreciated. There are, of course, additional features of the hand-held exercise apparatus that will be described hereinafter and which will form the subject matter of the claims appended hereto.

In this respect, before explaining at least one embodiment of the hand-held exercise apparatus in detail, it is to be understood that the hand-held exercise apparatus is not limited in its application to the details of construction and to the arrangements of the components set forth in the following description or illustrated in the drawings. The hand-held exercise apparatus is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present hand-held exercise apparatus. It is important, therefore, that the claims be regarded as including such equivalent constructions insofar as they do not depart from the spirit and scope of the present invention.

It is therefore an object of the present invention to provide a hand-held exercise apparatus which has all of the advantages of the prior art and none of the disadvantages.

It is another object of the present invention to provide a hand-held exercise apparatus which may be easily and efficiently manufactured and marketed.

It is another object of the present invention to provide a hand-held exercise apparatus which is of durable and reliable construction.

It is yet another object of the present invention to provide a hand-held exercise apparatus which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
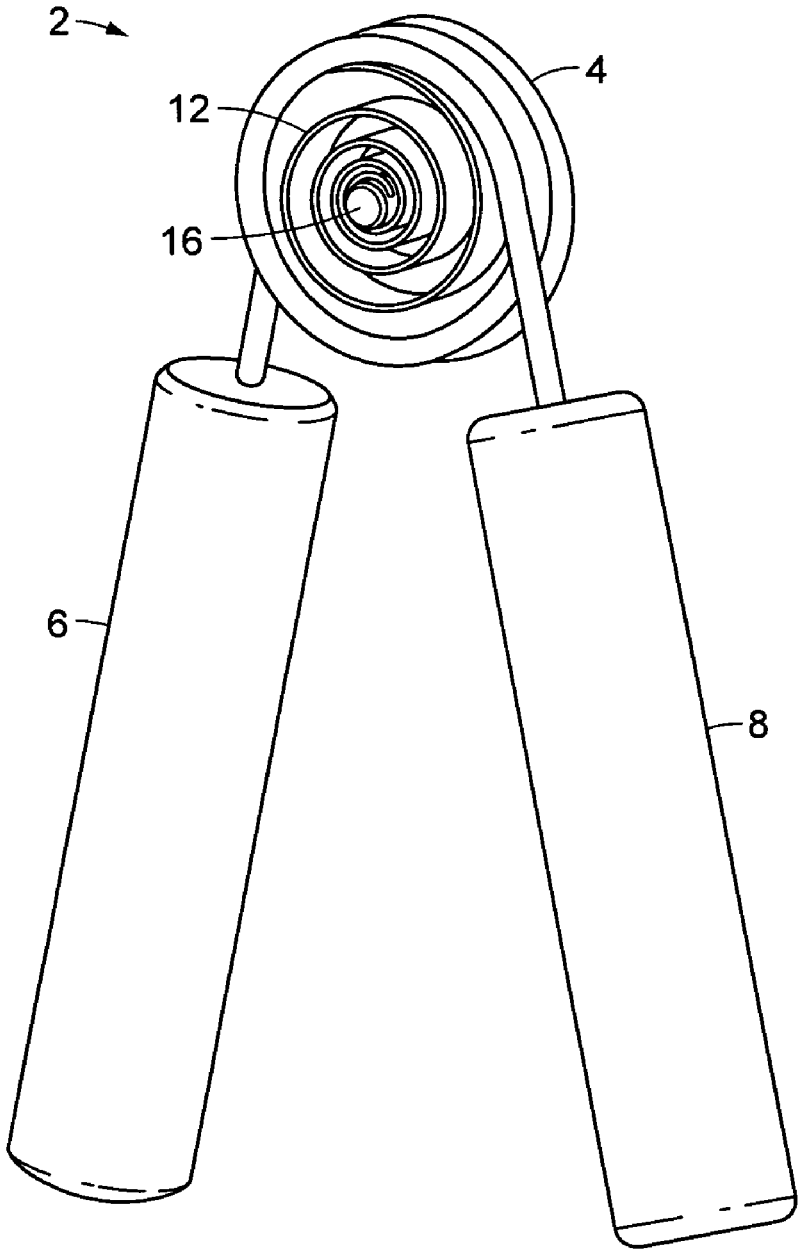
FIG. 1 shows a rear perspective view of the apparatus.
Figure 2:
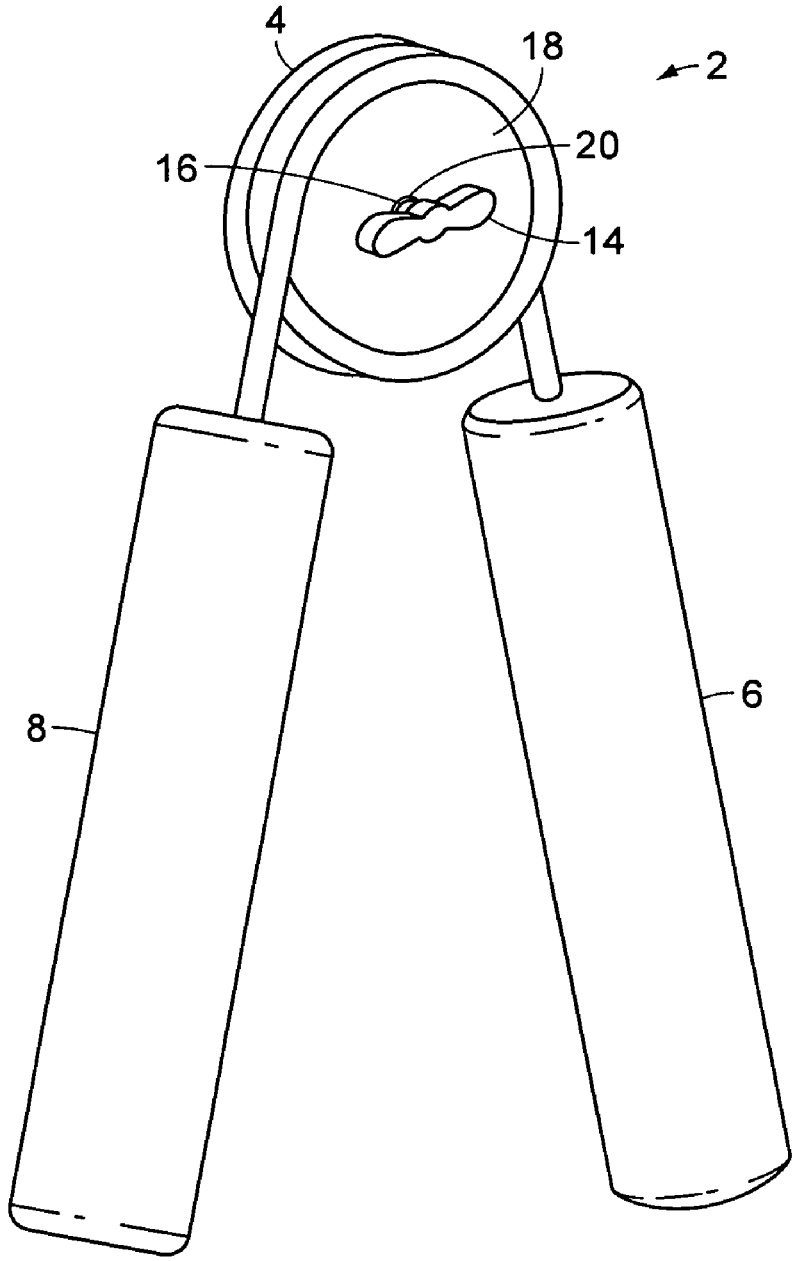
FIG. 2 shows a front perspective view of the apparatus.

FIG. 1 shows a rear perspective view of the apparatus 2, while FIG. 2 shows a front perspective view of the apparatus 2. Apparatus 2 is designed to strengthen an individual's wrist and hand muscles by allowing the user to vary the tensile strength of the apparatus 2.

Apparatus 2 comprises a circular coil 4 which has two ends, a first end and a second end. Circular coil 4 itself is wound around into a circle several times, which both ends of the circular coil 4 pointing in roughly the same direction approximately 10–30 degrees apart from one another.

Handle 6 is attached to the first end of circular coil 4, while handle 8 is attached to the second end of circular coil 4. Handles 6 and 8 are cushioned to allow an individual to grasp both handles at the same time, with one of the handles being placed against a user's hand palm while the other handle would be placed against a user's extended fingers. The goal of an individual would be to pull the two handles together with a single hand in an effort to strengthen hand and wrist muscles within that same particular hand.

Unlike traditional hand and wrist strengthening devices presently on the market, the apparatus 2 has a mechanism in which one can increase or decrease the tensile strength needed to pull the handles together. This mechanism is seen in FIG. 1.

As can be seen in FIG. 1, spring 12 has two ends, a first end and a second end. The first end of the spring 12 is centrally located and is attached to adjustment knob 14 via connector 16. Connector 16 has two ends, a first end and a second end, with the first end of the connector 16 being attached to the first end of the spring 12, with the second end of the connector 16 being attached to the adjustment knob 14. Connector 16 is preferably in the shape of a small rod. The second end of spring 12 is attached to the circular coil 4 in one or more locations. Spring 12 appears as a roll of tape and functions in a manner analogous to that of a clock spring.

Looking now at FIG. 2, the actual adjustment knob 14 can be seen. Adjustment knob 14 is separated from the spring 12 itself by a cover disc 18 that has a centrally located hole 20 through which connector 16 passes through. The diameter of cover disc 18 is slightly smaller than the diameter located within the coils of circular coil 4.

By adjusting the tensile strength of the spring 12 with adjustment knob 14, an individual can change the overall amount of power needed to squeeze the handles 6 and 8 together. Over time, this will allow an individual to build up resistance and strengthen their hand and wrist muscles for one or more hand.

I claim:

1. A hand-held exercise apparatus comprising:

a circular coil having two ends, a first end and a second end, the circular coil wound around several times, wherein the ends of the circular coil point outward approximately ten to thirty degrees apart from one another, the circular coil having a tensile strength, a first handle attached to the first end of the circular coil, a second handle attached to the first end of the circular coil, and means for adjusting the tensile strength needed to pulled the handles together, wherein an individual can exercise by grasping the two handles and pulling the two handles together repeatedly, wherein the means for adjusting the tensile strength needed to pulled the handles together further comprises:

a spring having a first end and a second end the second end of the spring being attached to the coil in at least one location, an adjustment knob, and a connector having a first end and a second end the first end of the connector being attached to the first end of the spring, the second end of the connector being attached to the adjustment knob, wherein an individual can adjust the tensile strength needed to pulled the handles together by turning the adjustment knob clockwise or counterclockwise.

2. A hand-held exercise apparatus according to claim 1 wherein the hand-held exercise apparatus further comprises a cover disc, the cover disc being used to separate the adjustment knob from the spring, wherein the cover disc has a centrally located hole, further wherein the connector passes through the centrally located hole.

3. A hand-held exercise apparatus according to claim 1 wherein the connector is rod-shaped.

* * * * *